United States Patent [19]

Eckrodt

[11] Patent Number: 4,726,088

[45] Date of Patent: Feb. 23, 1988

[54] PROCESS AND DEVICE FOR WET TREATMENT OF TEXTILE MATERIAL IN HANK FORM

[75] Inventor: Günter Eckrodt, Coesfeld, Fed. Rep. of Germany

[73] Assignee: Thies GmbH & Co., Fed. Rep. of Germany

[21] Appl. No.: 894,202

[22] Filed: Aug. 7, 1986

[30] Foreign Application Priority Data

Aug. 7, 1985 [DE] Fed. Rep. of Germany ..... 3528387

[51] Int. Cl.[4] ..... D06B 3/26; D06B 3/28

[52] U.S. Cl. ..... 8/152; 68/178

[58] Field of Search ..... 8/152; 68/177, 178

[56] References Cited

U.S. PATENT DOCUMENTS

| | | | |
|---|---|---|---|
| 2,997,871 | 8/1961 | Cutten et al. | 68/177 |
| 3,493,321 | 4/1970 | Inoue et al. | 68/177 X |
| 3,780,544 | 7/1973 | Turner et al. | 68/177 |
| 4,019,351 | 4/1977 | Mizutani et al. | 68/177 |
| 4,334,333 | 6/1982 | Yamada et al. | 68/177 X |
| 4,538,432 | 9/1985 | Bishop | 68/178 X |

FOREIGN PATENT DOCUMENTS

| | | | |
|---|---|---|---|
| 2714801 | 12/1977 | Fed. Rep. of Germany | 68/177 |
| 2412637 | 7/1979 | France | 68/177 |

*Primary Examiner*—Philip R. Coe

*Attorney, Agent, or Firm*—Stewart L. Gitler; Martin P. Hoffman; Mitchell B. Wasson

[57] ABSTRACT

The invention relates to a process and device for the wet treatment of textile material in hank form. The material travels in a circulating passage through an intensive treatment drawframe with subsequent folding-down, further conveying, and finally renewed feeding to the intensive treatment drawframe by a hank winding device. Circulating conveying of the treatment bath through the intensive treatment drawframe occurs while the textile material is passed through the horizontally arranged intensive treatment drawframe essentially at the same speed as the treatment bath. Such material is also under the action of the tensile force of a second hank winding device, which works at essentially the same conveying speed as the hank winding device upstream from the intensive treatment drawframe.

16 Claims, 3 Drawing Figures

PROCESS AND DEVICE FOR WET TREATMENT OF TEXTILE MATERIAL IN HANK FORM

SUMMARY OF THE INVENTION

The invention relates to a process and a device for the wet treatment of textile material in hank form.

The existing method of wet treatment of textile material in hank form comprises only the use of nozzles or overflow machines. The textile material, after it is fed by the transport hank winder to the intensive treatment drawframe, is further transported in the frame by the wet treatment bath. In this case, to guarantee a reliable transport of the material through the intensive treatment drawframe, the wet treatment bath is introduced into the intensive treatment drawframe at a speed that is significantly greater than the rotational speed of the textile material. This relative speed between the wet treatment bath and the textile material results in the surface of the textile material being damaged (pilling effect).

Surface damages to the textile material, which can also unfavorably affect subsequent treatment of the material, in themselves are always to be avoided.

To avoid this disadvantage, the object of the invention is to improve the treatment process so that the surface damages caused by a relative speed between textile material and treatment bath are avoided.

This object is achieved according to the present invention.

One essential component for the design according to the invention is a horizontal passage of the textile material in a correspondingly arranged intensive treatment drawframe. Influencing the speed of the wet treatment bath by reduction of the feeding speed in the nozzle or overflow unit itself can bring no effective improvement. This can be attributed to the fact that, in the present known process, the intensive treatment drawframe is generally a frame directed downward, on whose upper end the textile material and the wet treatment bath are fed, and on whose lower end the textile material and wet treatment bath are removed. If the speed of the wet treatment bath at the intake end of the intensive treatment drawframe were solely to be reduced such that no relative speed existed between the textile material and the wet treatment bath, such control would only affect the intake end of the wet intensive treatment drawframe since, in the further course, the wet treatment bath, because of the possibility of free fall, would increase in speed, so that again an increasingly greater relative speed in regard to the textile material would exist.

If the intensive treatment drawframe and the conveying path of the textile material are horizontally aligned and at the same time the feeding speed of the treatment bath at the intake end of the intensive treatment drawframe is adjusted to the transport speed of the textile material, there is considerable danger of relatively early blockage of the intensive treatment drawframe because of the lack of sufficient conveying action on the textile material. Consequently, the invention provides as a further unconditional feature a drawing action on the textile material from the delivery side of the intensive treatment drawframe. The second hank winding device is provided as this additional feature. The second hank winder, placed downstream from the intensive treatment drawframe, works essentially at the same speed as the first. Only in this way is a reliable transport of the textile material through the intensive treatment drawframe assured, with the action of special excessively high tensile forces on the textile material avoided.

Ideally, one requires a uniform distribution of the tensile force from the second hank winding device acting on the textile material, and the wet treatment bath on the textile material during the common passage through the intensive treatment drawframe. In order to obtain a uniform distribution of the tensile force, the intensive treatment drawframe is widened conically in the direction of the delivery end. As a result, the textile material is spread from the original hank form at the intake end of the intensive treatment drawframe to a practically full spread web. To facilitate or promote this spreading, the textile material is under a tensile force applied by the second hank winding device. The second hank winding device can be designed as a so-called expander roller, i.e., as a roller that in conveying the textile material over a part of its periphery continuously spreads it crosswise to the direction of transport—in other words, in the direction of the width of the textile material.

By the design according to the invention, a process, method and pertinent device are provided which actually allow wet treatment of textile material that is free of surface damages, at least those related to surface damages caused by a relative speed between textile material and wet treatment bath. As a result, one is provided reliable transport of the textile material through the intensive treatment drawframe.

BRIEF DESCRIPTION OF THE DRAWINGS

A preferred embodiment of the invention is described below as referenced by FIG. 1, which shows a representation of a wet treatment device, which works according to the overflow principle.

FIG. 2 is a cross-sectional elevation of the intensive treatment tank taken along the line A—A from FIG. 1.

FIG. 3 is an alternate embodiment of the invention displaying a conical configuration of the intensive treatment tank.

DESCRIPTION OF THE PREFERRED EMBODIMENT

Figure 1:
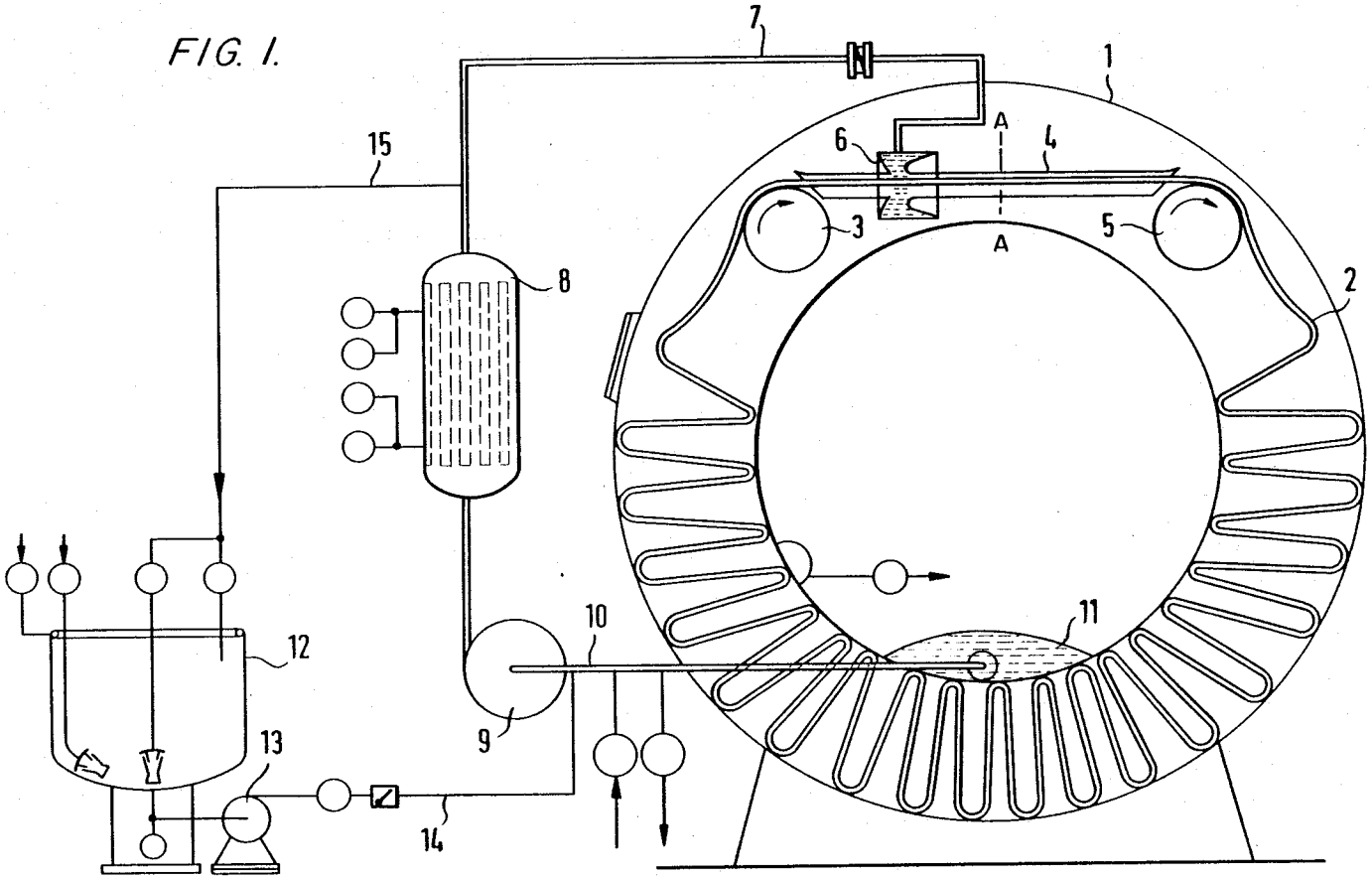

As illustrated in the drawing textile material 2 circulates within a wet treatment tank 1. Flat-folded textile material 2 inside the wet treatment tank 1 is received by a first hank winding device 3 from the lower area of wet treatment tank 1 and fed to an intensive treatment drawframe 4. Textile material 2 moves through this intensive treatment drawframe 4 to a second hank winding device 5, which pulls the textile material through intensive treatment drawframe 4 with drawing action and again delivers it to the lower area of wet treatment tank 1.

In the intake area of intensive treatment drawframe 4 a so-called overflow unit 6 is provided, by which the treatment bath can be introduced into the inside of intensive treatment drawframe 4 under a certain pressure and at a certain speed. In this way, textile material 2 is brought intensively into contact with the wet treatment bath within intensive treatment drawframe 4 or is rinsed by it, on which the actual wet treatment action is based.

Intensive treatment drawframe 4 is a frame configured as a tube frame with horizontal arrangement. Consequently, in flowing through intensive treatment drawframe 4, the wet treatment bath experiences no special acceleration, i.e. its speed remains constant. In the design according to the invention, the speed of feeding of the wet treatment bath by overflow unit 6 to intensive treatment drawframe 4 is geared to the transport speed of the two hank winding devices 3 and 5 by an essentially equal adjustment of all speeds. In this way, there is no relative speed between textile material 2 and the wet treatment bath within intensive treatment drawframe 4.

The two hank winding devices 3 and 5 are driven devices, whereby second hank winding device 5 can operate at a slightly higher speed than first hank winding device 3, in any case, to avoid blockage of intensive treatment drawframe 4 by textile material 2 for any reason.

Overflow unit 6 is first connected by a feed pipe 7 to a heat exchanger 8 which, for its part, is connected to a circulating pump 9. By a suction pipe 10, the pump is connected to the lower inside area 11 of wet treatment tank 1. For feeding of the treatment bath to the chemicals that are to be added, a storage tank 12 is used with a downstream pump 13, whose pressure line 14 comes out in suction pipe 10 of circulating pump 9.

A shunt 15 leads form feed pipe 7 into the inside of storage tank 12.

In the entire circulating system as well as in the pipes of the metering system, a series of valves is provided which valves serve to feed and remove the treatment bath to the wet treatment tank 1, the hot water or steam to heat exchanger 8 and chemicals, or already dissolved chemicals, to storage tank 12, and also to feed the wet treatment bath to the preparation of chemicals. Here, ordinary devices are involved which need no further explanation.

By the equal design of the peripheral speed of textile material 2 and the wet treatment bath in the intensive treatment drawframe 4 and by the resultant avoidance of relative speed between textile material 2 and the wet treatment bath in the desired way, a gentle surface treatment of textile material 2 is achieved.

Instead of overflow unit 6, a nozzle unit can be provided, whereby the wet treatment bath is introduced into intensive treatment drawframe 4 by the action of a special pump pressure.

While in the case of a nozzle unit the speed of feeding of the wet treatment bath to intensive treatment drawframe 4 can be controlled by a corresponding adjustment of the delivery of circulating pump 9, this is possible in the case of overflow unit 6. The intake cross-section of the overflow tank to the intake of the wet treatment bath of intensive treatment drawframe 4 is adjusted in every way suitable for this purpose. A feed adjustment of overflow units from or to them has already been realized several times.

By a corresponding adjustment of the overflow unit, the same result is reached as that achieved by corresponding adjustment of circulating pump 9 upstream from the nozzle unit, so that the result in both cases is a gentle surface treatment of textile material 2.

I claim:

1. A process for wet treatment of textile material in hank form comprising the steps of circulating the textile material through an intensive treatment drawframe, after which the textile material is first folded down, then conveyed in folded-down form and finally fed to the intensive treatment drawframe by a hank winding device, further comprising circulating conveying of the treatment bath through the intensive treatment drawframe, after which the treatment bath is collected and fed by a circulating pipe first to a pump and from it to the intensive treatment drawframe, in which the treatment bath is introduced, wherein the textile material is passed through the intensive treatment drawframe essentially at the same speed as the treatment bath, passing of the textile material through the intensive treatment drawframe is horizontal, and the textile material is passed through the intensive treatment drawframe under the action of a tensile force, which comes from a second hank winding device which works at essentially the same conveying speed as the hank winding device upstream from the intensive treatment drawframe.

2. A process according to claim 1, wherein the textile material, when being passed through the intensive treatment drawframe, is spread out.

3. A process according to claim 1, wherein the treatment bath is introduced into the intensive treatment drawframe by a means to control the speed and amount of treatment material introduced into said process.

4. A process according to claim 3, whereby an overflow unit introduces the treatment bath into said intensive treatment drawframe.

5. A device for implementing the process according to claim 1, comprising a treatment tank having a bottom and a top, a horizontal tube shaped intensive treatment drawframe having an intake and a delivery end placed in the top of said tank, a first hank winding device upstream from said intensive treatment drawframe for transporting the textile material to the intensive treatment drawframe and a second hank winding device downstream from said intensive treatment drawframe assisting in drawing said textile material and an introduction means in the area of said intake of said intensive treatment drawframe for introducing the treatment bath into said intensive treatment drawframe, said introduction means is connected by a pipe to a circulating pump which is connected on the suction side to the bottom part of the treatment tank for suction of the treatment bath located therein and furthermore wherein said first and second hank winders can be driven at a conveying speed which essentially corresponds to the circulating speed of the treatment bath through said intensive treatment drawframe.

6. A device according to claim 5, wherein an overflow unit is utilized to introduce the treatment bath into said intake of the intensive treatment drawframe.

7. A device according to claim 6, wherein the intensive treatment drawframe is a tube frame rectangular in cross-section.

8. A device according to claim 7, wherein said intensive treatment drawframe is widened conically in the direction of the delivery end.

9. A device according to claim 8, wherein second hank winder is an expanding roller.

10. A device according to claim 6, wherein said intensive treatment drawframe is widened conically in the direction of the delivery end.

11. A device according to claim 10, wherein second hank winder is an expanding roller.

12. A device according to claim 5, wherein the intensive treatment drawframe is a tube frame rectangular in cross-section.

13. A device according to claim 12, wherein said intensive treatment drawframe is widened conically in the direction of the delivery end.

14. A device according to claim 13, wherein second hank winder is an expanding roller.

15. A device according to claim 5, wherein said intensive treatment drawframe is widened conically in the direction of the delivery end.

16. A device accoroding to claim 15, wherein second hank winder is an expanding roller.

* * * * *